United States Patent [19]

Dickerson et al.

[11] Patent Number: 5,041,364

[45] Date of Patent: Aug. 20, 1991

[54] DIAGNOSTIC PHOTOGRAPHIC ELEMENTS EXHIBITING REDUCED GLARE FOLLOWING RAPID ACCESS PROCESSING

[75] Inventors: Robert E. Dickerson; Robert L. Childers, both of Rochester, N.Y.

[73] Assignee: Eastman Kodak Company, Rochester, N.Y.

[21] Appl. No.: 590,715

[22] Filed: Oct. 1, 1990

[51] Int. Cl.[5] ..... G03C 1/46

[52] U.S. Cl. ..... 430/502; 430/567; 430/963; 430/966

[58] Field of Search ..... 430/502, 567, 963, 966

[56] References Cited

U.S. PATENT DOCUMENTS

| | | | |
|---|---|---|---|
| Re. 31,847 | 3/1985 | Luckey | 250/327.2 |
| 3,237,008 | 2/1966 | Dostes et al. | 430/502 |
| 3,589,908 | 6/1971 | Plakunov | 430/600 |
| 4,733,090 | 3/1988 | DeBoer et al. | 250/484.1 |
| 4,900,652 | 2/1990 | Dickerson et al. | 430/502 |

*Primary Examiner*—Charles L. Bowers, Jr.
*Assistant Examiner*—Janet C. Baxter
*Attorney, Agent, or Firm*—Carl O. Thomas

[57] ABSTRACT

A diagnostic photographic element is disclosed containing reduced surface glare following rapid-access processing. The photographic elements contain silver halide emulsion imaging units and overlying layer units that contain to reduce surface glare a tabular grain silver halide emulsion in which the tabular grains have an average diameter greater than 1.5 μm and an average tabularity of greater than 25.

14 Claims, 1 Drawing Sheet

DIAGNOSTIC PHOTOGRAPHIC ELEMENTS EXHIBITING REDUCED GLARE FOLLOWING RAPID ACCESS PROCESSING

FIELD OF THE INVENTION

The invention relates to diagnostic photographic elements of the type employed in medical radiology.

BACKGROUND OF THE INVENTION

In arriving at a diagnosis a medical radiologist typically relies to a large extent, often entirely, on a visual study of silver images in photographic films. Image inspection usually occurs with the film mounted on a light box, a white, translucent illumination source. To facilitate an accurate diagnosis a number of varied images are usually mounted and studied together.

As employed herein the term "diagnostic photographic film" is employed to encompass the photographic films acceptable for producing the images studied for diagnosis. Acceptability depends not only on the quality of the image, but also on the rapidity of processing to render the image visually accessible.

Initially, silver halide photographic elements were exposed to X-radiation alone to produce viewable silver images. Because X-radiation is highly energetic, a large portion of the exposing X-radiation passes through a silver halide photographic element unabsorbed. Two strategies were developed to increase X-radiation absorption. First, silver halide emulsion layer units were coated on opposite sides of a film support, resulting in two superimposed silver images having the appearance of a single image of higher contrast. Second, intensifying screens were developed containing phosphors capable of absorbing X-radiation more efficiently than silver halide and promptly fluorescing to expose the silver halide with emitted longer wavelength light. In this arrangement the silver halide emulsion layer units are exposed to both X-radiation and emitted light, although the emitted light is primarily responsible for the image formed.

Since the patient being examined cannot be released until successful recording of the set of images needed for diagnosis has been confirmed, diagnostic photographic films have been constructed to provide a rapid-access imaging capability. The commonly accepted rapid-access standard is for processing to be completed in 90 seconds or less.

Dickerson et al U.S. Pat. No. 4,900,652 illustrates a diagnostic photographic film that provides a combination of low patient X-radiation dosage, high image quality and rapid-access processing typical of the highest standards of performance.

Although traditionally diagnostic photographic elements have themselves been exposed to X-radiation image patterns, even when longer wavelengths of light were primarily relied upon for latent image formation, alternatives are now becoming available to the radiologist for capturing the X-radiation image. For example, the X-radiation image can be captured in a storage phosphor screen. By subsequently scanning the exposed storage phosphor screen with stimulating radiation, an emission profile can be read out and sent to a computer for storage. An illustration of this imaging approach is provided by Luckey U.S. Pat. No. Re. 31,847 and DeBoer et al U.S. Pat. No. 4,733,090.

To provide the radiologist with a viewable image that can be studied in the same way as more traditionally captured images, the computer stored image information can be used as recorded or with computer enhancement to expose a diagnostic photographic film, usually using a modulated laser beam as an exposure source. After exposure the diagnostic photographic film is run through the same rapid-access processing cycle used for processing diagnostic photographic films directly exposed to X-radiation. It is important to note that the radiologist, for efficiency of effort, uses a single rapid-access processing route and, for accuracy of diagnosis, arrives at comparable viewable silver images in the diagnostic photographic films, even though the images are derived from alternative exposure routes.

One of the difficulties encountered by radiologists in studying images in diagnostic photographic films is surface glare (measured in terms of surface gloss). For example, specular reflection of room lights or adjacent light box panels can make accurate viewing of maximum density image areas impossible from a particular viewing position. Dimming other sources of illumination in the viewing room, shifting position and accepting a certain level of eye strain are the penalties involved. For a skilled diagnostician, surface glare is an obstacle to accurate diagnoses and a major source of fatigue.

The most closely relevant prior art diagnostic photographic film to the subject matter of this invention is commercially sold under the trademark Kodak Ektascan HN Film. In this diagnostic photographic film an interlayer is positioned between a silver halide emulsion layer unit and a gelatin overcoat. The interlayer contains a sensitized spherical grain silver halide emulsion with a silver coverage of 32 percent, based on total silver in the emulsion layer unit and interlayer. As originally introduced the film contained half this level (16 percent) of silver in the interlayer, but, as shown below, at this level the silver was relatively ineffective in reducing surface glare. The current diagnostic photographic film still exhibits significant surface glare, allowing bright, sharp specular reflections of fluorescent room lights to be viewed in maximum density areas of the processed film.

In addition to allowing a high level of surface glare to persist, a further disadvantage of the interlayer approach was that a relatively high proportion of additional silver was required in the interlayer to achieve modest glare reductions.

Of interest in connection with certain preferred forms of the invention, Plakonov U.S. Pat. No. 3,589,908 discloses to be useful in silver halide emulsions to increase speed and contrast a binder consisting of a combination of gelatin, a carboxymethylated protein, and at least one other hydrophilic colloid selected from the group consisting of polyacrylamide, polysaccharides, and poly-N-vinyl pyrrolidone.

SUMMARY OF THE INVENTION

In one aspect, this invention is directed to a diagnostic photographic film capable of producing a viewable silver image and exhibiting reduced surface glare when processed in up to 90 seconds comprised of a film support, at least one image-forming layer unit coated on the support containing less than 65 mg/dm$^2$ of hydrophilic colloid, the image-forming layer unit being comprised of a silver halide emulsion layer unit containing radiation-sensitive silver halide grains and at least one hydrophilic colloid and an overlying layer unit containing a silver halide emulsion and less than 25 percent of the total hydrophilic colloid present in the image-forming layer unit.

The diagnostic photographic element is characterized in that the overlying layer unit contains a tabular grain silver halide emulsion in which the tabular grains have an average diameter greater than 1.5 μm and an average tabularity of greater than 25, where the tabularity of each tabular grain is the ratio of its effective circular diameter in micrometers divided by the square of its thickness measured in micrometers.

The present invention offers a number of advantages over the prior state of the art. First, surface glare can be reduced to the point that no reflected image of ordinary fluorescent room lighting is visible on the surface of the processed diagnostic photographic films of this invention in maximum density areas, rather these areas have a dull black appearance with only the slightest suggestion of light reflection. This is in direct contrast to glossy and reflective surfaces presented by comparable diagnostic photographic films lacking the overlying layer unit required by the invention. Further, this is a striking improvement over the discontinued diagnostic photographic film described above.

Not only can surface glare of the processed film be reduced to nominal levels, thus obviating image reading limitations, the amount of silver required in the overlying layer unit to achieve a specified level of surface gloss has been significantly reduced. As compared to the discontinued diagnostic photographic film described above, lower gloss or lower overlying layer unit silver levels at comparable levels of gloss can be achieved. In other words, the diagnostic photographic films of this invention make more efficient use of overlying layer unit silver.

It is a highly surprising feature of this invention that tabular silver halide grains in the overlying layer unit essentially eliminate glare. If asked to predict in the absence of actual comparisons, those skilled in the art would have predicted that the substitution of tabular grains for nontabular grains in the overlying layer unit of a diagnostic photographic film, if capable of making a significant difference, would increase surface glare. The reason for this is that tabular grains in photographic elements inherently orient themselves parallel to the film support and thereby present smoother, more ordered surfaces than nontabular grains.

It is still more surprising that the reductions in surface glare (measured in terms of gloss) are most pronounced when the tabular grains in the overlying layer unit have an average diameter greater than about 1.5 μm. Again, the trend of increased reductions in surface glare with increasing tabular grain average diameters runs exactly counter to what would have been intuitively predicted in the absence of the experimental observations presented below.

A further surprising feature of the invention is that the reduction of surface glare in the diagnostic photographic films is not accompanied by objectionable increases of turbidity (measured as haze) in minimum density areas. In other words, the sharpness of image detail, highly important to some diagnostic applications (e.g., mammography), is not objectionably degraded. As compared to latex beads, for example, the overlying layer unit tabular grains produce both larger reductions in surface glare and sharper images (less haze).

Since surface glare is a surface phenomenon, it was not immediately apparent nor predictable that the reduced surface glare diagnostic photographic films of this invention would have properties allowing them to be used with conventional rapid-access processing equipment. For example, it was not apparent nor predictable whether these elements could be fed one sheet at a time with conventional automatic loading and processing equipment. Investigations have revealed that the reduced surface glare diagnostic photographic films of this invention are compatible with existing rapid-access processing equipment, including that having the automatic sheet feeding and handling features.

Since the substitution of tabular grains for nontabular grains in the overlying layer unit produces advantages that run counter to intuitive predictions based on the known properties of tabular grains, it has been concluded that it is not the tabular grains or their placement alone that accounts for the advantages observed. Rather, it is believed that it is the combination of the tabular grains, their placement and the hydrophilic colloid coating coverages necessary for facilitating rapid-access processing that account for the advantageous properties of the diagnostic photographic films of this invention. In a specific, preferred form of the invention the lowest measured levels of surface gloss have been achieved by employing a hydrophilic colloid formulation known to be useful for facilitating rapid-access processing, but not heretofore known to be useful for surface gloss reduction.

BRIEF DESCRIPTION OF THE DRAWINGS

Further advantages of the invention will become apparent from the following detailed discussion of preferred embodiments considered in conjunction with the drawings.

PREFERRED EMBODIMENTS

Figure 1:
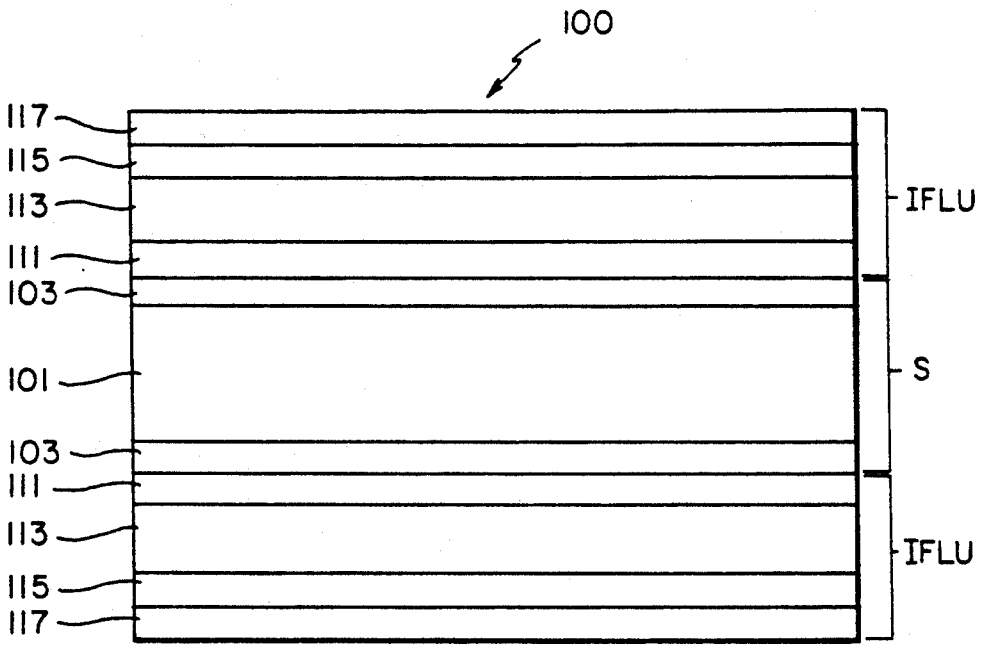
FIG. 1 is a schematic diagram of a dual coated format diagnostic photographic film according to the invention.

A diagnostic photographic film 100 according to the invention particularly adapted for traditional radiographic imaging is shown in FIG. 1. The diagnostic photographic film is in this instance a radiographic film, since it is adapted for X-radiation exposure, usually while mounted between a pair of intensifying screens, not shown. The radiographic film is comprised of two image-forming layer units IFLU and a photographic film support S consisting of a transparent film 101, which is typically blue tinted, and two under layer units 103 located on opposite major faces of the film having as their primary purpose to improve adhesion of hydrophilic colloid layers to the film.

The image-forming layer units IFLU each consist of a plurality of hydrophilic colloid layers. As shown each of the image-forming layer units is comprised of an optional crossover reduction layer unit 111, a silver halide emulsion layer unit 113, and an overlying layer unit comprised of an interlayer 115 and an overcoat layer 117.

The image-forming layer units each contain at least one silver halide emulsion layer comprised of radiation-sensitive latent image forming silver halide grains. The silver halide grains are in every instance chemically sensitized to improve their sensitivity. When the radiographic film is intended to be used with intensifying screens, the latent image forming silver halide grains are usually additionally spectrally sensitized by employing one or a combination of spectral sensitizing dyes providing a peak absorption at or near a wavelength of peak intensifying screen emission.

The crossover reduction layer unit functions to improve sharpness in the image-forming layer units exposed with intensifying screens. Each crossover reduction layer unit increases image sharpness by intercepting light emitted by an intensifying screen that has passed through the silver halide emulsion layer unit nearest the screen. This prevents or reduces exposure of the silver halide emulsion layer unit on one side of the support by an intensifying screen on the opposite side of the support. If intensifying screens are not employed—that is, X-radiation alone is used for exposure, the crossover reduction layer units can be omitted without any reduction in image sharpness. If the silver halide grains present a high surface area to volume ratio and are spectrally sensitized, the emulsion layer units themselves are often capable of sufficiently reducing crossover to allow the crossover reduction layer units to be omitted without an unacceptable reduction in sharpness, depending upon the specific imaging application.

Each overlying layer unit can be a single layer, but each is preferably, as shown, constructed of an overcoat layer 117 and an interposed layer 115. The overcoat layers 117 perform the function of physically protecting the emulsion layer units. It is also conventional practice to incorporate antistatic agents in overcoat layers to eliminate static electrical surface charge. Left uncontrolled, static discharge can objectionable produce maximum density streaks in the processed film.

The function of the interlayer 115 is to reduce surface glare (measured as surface gloss) exhibited by the radiographic film after imagewise exposure and processing. In addition to hydrophilic colloid, present in each of the layers of the image-forming layer units, the interlayer contains silver halide grains. The silver halide grains in the interlayer can, but need not be intentionally sensitized. Depending upon the choice of spectral sensitizing dye incorporated in the silver halide emulsion layer unit, it is recognized that spectral sensitizing dye can in some instances migrate to the silver halide grains in the interlayer. Inadvertent chemical sensitization of the interlayer silver halide grains is, however, highly unlikely, if not impossible, since silver halide emulsions are normally chemically sensitized at temperatures well in excess of those encountered during or subsequent to coating of the hydrophilic colloid layers.

The diagnostic photographic film 100 has a dual coated format. That is, separate silver images are formed on opposite sides of the support and are later viewed in superimposed relationship as a single composite image. The dual coated format provides the most image information for the least subject exposure to X-radiation.

For many diagnostic applications a dual coated format is not required. A radiographic film with a useful single-sided format can be similar to the radiographic film 100, but differ by omitting the image-forming unit on one side of the film support. In this instance the retained crossover reduction layer unit 103 no longer functions to reduce crossover, since only a single screen mounted adjacent the one remaining image-forming layer unit is present during exposure. Using a single intensifying screen, the crossover layer unit continues to improve image sharpness by intercepting light emitted by the intensifying screen that is reflected from the backside of the film support—i.e., the crossover reduction layer unit in the single-sided format functions as an antihalation layer.

Figure 2:
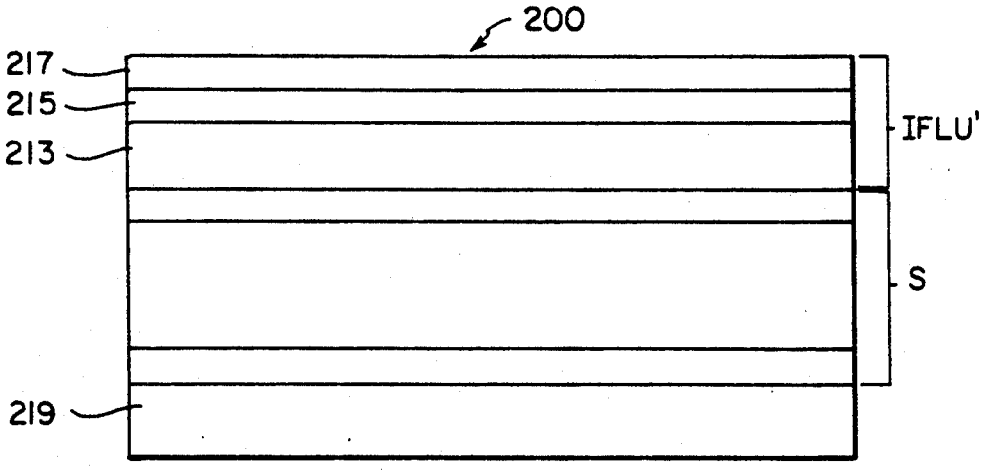
FIG. 2 is a schematic diagram of a single-sided format diagnostic photographic film according to the invention.

In FIG. 2 a single-sided format diagnostic photographic film 200 of a preferred construction is disclosed. The film support S can be identical to that of film 100. The one image-forming layer unit IFLU' consists of emulsion layer unit 213, interlayer 215 and overcoat 217, corresponding to 113, 115 and 117, respectively, of film 100.

The difference between the single-sided format variation of film 100 described above and diagnostic photographic film 200 is that the former contains a crossover reduction layer unit interposed between the emulsion layer unit performing an antihalation function while the latter includes an anticurl and antihalation layer unit 219 on the back side of the support. The dual coated format of FIG. 1 requires no anticurl feature because of the offsetting forces exerted by the hydrophilic colloid layers on opposite sides of the support. In a single-sided format a hydrophilic layer coated on the back side of the support provides the offsetting force required to diminish any tendency toward curl. The advantage of placing the antihalation feature on the back side of the support rather than between the emulsion layer unit and the photographic film support is that it is more accessible during processing and therefore more easily removed or decolorized.

All of the diagnostic photographic film constructions described above can be imagewise exposed with X-radiation alone or X-radiation and longer wavelength radiation emitted by one or a pair of intensifying screens. The diagnostic photographic films with single-sided format constructions can be imagewise exposed with longer wavelength radiation alone. For example, single-sided format diagnostic photographic elements are contemplated to be imagewise exposed by a laser having any convenient wavelength ranging from the near ultraviolet to the near infrared (e.g., 350 to 1300 nm). In such use the diagnostic photographic film can, for example, receive image information that was originally generated by patient exposure to X-radiation that was subsequently read from the original recording medium and stored in computer memory for later use. Computer instructions for digital or analog modulation of the exposing laser coupled with raster scanning of the diagnostic photographic film recreates the original X-radiation image pattern.

For the diagnostic photographic films of this invention to be acceptable for use by radiologists not only the quality of the image, but also the accessibility of the image is important. Therefore, the diagnostic photographic films of this invention are constructed to be compatible with rapid-access processing—i.e., processing to a viewable silver image in 90 seconds or less.

Since rapid-access processors employed commercially vary in their specific processing cycles and selections of processing solutions, the diagnostic photographic films satisfying the requirements of the present invention are specifically identified as being those that are capable of emerging dry to the touch when processed in 90 seconds according to the following reference conditions:

| | |
|---|---|
| development | 20 seconds at 40° C., |
| fixing | 12 seconds at 40° C., |

-continued

| | |
|---|---|
| washing | 8 seconds at 40° C., and |
| drying | 20 seconds at 65° C., |

where the remaining time is taken up in transport between processing steps. The development step employs the following developer:

| | |
|---|---|
| Hydroquinone | 30 g |
| 1-Phenyl-3-pyrazolidone | 1.5 g |
| KOH | 21 g |
| $NaHCO_3$ | 7.5 g |
| $K_2SO_3$ | 44.2 g |
| $Na_2S_2O_5$ | 12.6 g |
| NaBr | 35 g |
| 5-Methylbenzotriazole | 0.06 g |
| Glutaraldehyde | 4.9 g |
| Water to 1 liter at pH 10.0, and the fixing step employs the following fixing composition: | |
| Ammonium thiosulfate, 60% | 260.0 g |
| Sodium bisulfite | 180.0 g |
| Boric acid | 25.0 g |
| Acetic acid | 10.0 g |
| Aluminum sulfate | 8.0 g |
| Water to 1 liter at pH 3.9 to 4.5. | |

It is, of course, recognized that recently developed rapid-access processes having processing cycles in the range of from 60 to 30 seconds and less have been developed, as illustrated by Cumbo et al U.S. Ser. No. 537,668, filed June 14, 1990, pending commonly assigned. The preferred forms of the diagnostic photographic films of this invention are useful in these accelerated processing cycles.

To provide the diagnostic photographic films of this invention with a rapid-access processing capability, it is essential that each image-forming layer unit have a hydrophilic colloid content of less than 65 mg/dm$^2$. The bulk of the hydrophilic colloid is required for the emulsion layer unit, with less than 25 percent of the hydrophilic colloid present in an image-forming unit being required to form the overlying layer unit. The minimum amount of hydrophilic colloid contained in the image-forming layer unit varies, depending upon the nature and coating coverage of silver halide present in the silver halide emulsion layer unit. Dickerson et al U.S. Pat. No. 4,900,652, the disclosure which is here incorporated by reference, suggests a minimum hydrophilic colloid content in each image-forming unit of at least 35 mg/dm$^2$ to avoid wet pressure sensitivity. This value was, however, selected for a dual coated element containing optimally sensitized tabular grain emulsions. For single-sided format diagnostic elements having much lower levels of sensitivity, as can be readily accommodated with a laser exposure source, hydrophilic colloid levels in each image-forming layer unit can be reduced significantly. For example, hydrophilic colloid in the image-forming layer units at levels of 20 mg/dm$^2$ or lower are contemplated.

In a preferred symmetrical dual coated format of the type shown in FIG. 1 the diagnostic photographic films contain two image-forming units each containing about 18 to 30 mg/dm$^2$, optimally 21 to 27 mg/dm$^2$, of silver in its silver halide emulsion layer unit with the silver halide emulsions preferably being tabular grain emulsions with a tabularity of greater than 25. In these silver coating density ranges a combined silver image for viewing can be readily obtained having a maximum optical density in the normally preferred range of from 3 to 4. The silver coverages can be adjusted upwardly for applications requiring higher maximum optical densities and downwardly for those allowing lower maximum optical densities. Additionally, if infectious development of silver halide in the interlayer occurs, the silver coating densities in the silver halide emulsion layer units can be reduced somewhat below the ranges indicated while still achieving maximum optical densities in the preferred range of from 3 to 4.

In a single-sided diagnostic photographic film intended to be exposed by a laser and capable of producing maximum optical densities in the normally preferred range of from 3 to 4 it is not necessary to double the image-forming layer unit silver coating density as compared to that of one of the image-forming layer units of the preferred dual coated format diagnostic element described above to compensate for having only a single image-forming layer unit available for imaging. By employing finer grain (e.g., 0.2 to 0.6 μm mean grain diameter) emulsions higher silver image covering power levels can be achieved for a given silver coating density. For the type of application here described preferred silver coating densities are in the range of from about 25 to 40 mg/dm$^2$, optimally about 30 to 35 mg/dm$^2$. By choosing higher covering power emulsions even lower silver coating densities are possible. A practical weight ratio range of the vehicle of an emulsion, consisting principally of hydrophilic colloid, to the silver halide grains is generally recognized to be from 2:1 to 1:2, with a weight ratio of approximately 1:1 being typical. Taking this into account, it is apparent that the higher silver coating densities of the single-sided format image-forming layer units can be readily accommodated without exceeding the 65 mg/dm$^2$ upper limit of hydrophilic colloid contemplated for rapid-access processing.

The overlying layer unit accounts for less than 25 percent, preferably from about 10 to 20 percent, of the total hydrophilic colloid of each image-forming layer unit. When the overlying layer unit consists of a single layer, it can contain any of the materials described for inclusion in the overcoat, the interlayer, or both. When the overlying layer unit is divided into an interlayer and overcoat, each of the interlayer and overcoat preferably contains at least 5 percent of the total hydrophilic colloid of the image-forming layer unit. The hydrophilic colloid levels in the interlayer and overcoat can be independently selected within the combined range limits set forth.

By limiting the hydrophilic colloid within each image-forming layer unit the amount of liquid that is ingested by the diagnostic photographic film during processing is limited. It is important that the liquid ingested be limited, since this liquid must be removed from the film by drying. Excessive ingestion of liquid translates into increased drying requirements that cannot be met in up to 90 seconds with commercially available processing equipment.

It is, of course, recognized that it is not only the total coating density of hydrophilic colloid within each image-forming layer unit that controls liquid ingestion, but also the properties of the hydrophilic colloid. Hydrophilic colloids are chosen for image-forming layer unit construction because they are processing solution permeable, but it is also important that they not be susceptible to excessive liquid ingestion. One approach that has been used in the art for describing maximum permissible liquid ingestion for processing solution permeable hydrophilic colloid layers has been in terms of a swell test. Since hardeners are used to regulate the liquid ingestion capabilities of the more common photographic vehicles, including gelatin and gelatin-derivatives, swell tests have been presented as measures of fore-hardening (hardening before processing). Preferred image-forming layer units of the diagnostic photographic elements of this invention satisfy the forehardening swell test set out by Dickerson et al U.S. Pat. No. 4,900,652, the disclosure of which is here incorporated by reference. Stated in another way, the preferred hydrophilic colloids in the diagnostic photographic elements of this invention are those that require no pre-hardening (processing solution hardening). This includes a very broad range of hydrophilic colloids conventionally used in conventional color photographic elements, conventional black-and-white photographic elements, and high tabularity emulsion radiographic elements, none of which require further hardening during processing.

The emulsions incorporated in the overlying layer units of the image-forming layer units of the diagnostic photographic films of this invention are tabular grain emulsions. As herein employed, the term "tabular grain emulsion" refers to any emulsion in which at least 50 percent of the total grain projected area is accounted for by tabular grains. The tabular grain emulsions are selected based upon the criteria of (1) tabularity and (2) mean tabular grain diameter.

The tabular grain emulsions in the overlying layer units have a tabularity greater than 25. The tabularity of a single tabular grain is D divided by $t^2$, where D is the equivalent circular diameter of the grain in micrometers and t is the thickness of the tabular grain in micrometers. Tabularity can be viewed as the ratio of the aspect ratio (D/t) to tabular grain thickness (t). When any combination of tabular grains having a mean tabularity of greater than 25 in a statistically significant grain sample accounts for at least 50 percent grain projected area of the grains in the sample, the emulsion satisfies the tabular grain requirements of the invention. Mean tabularities of greater than 40 are preferred and are mean tabularities are optimally greater than 60. Tabularities can range up to 1000 or higher, but are preferably chosen to be less than about 500 in the absence of a feature capable of producing a shift to colder image tones.

While all tabular grain emulsions having a mean tabularity greater than 25 are capable of the reducing surface glare (measured gloss) when incorporated in the overlying layer unit, it has been discovered quite unexpectedly that a very marked reduction in gloss occurs when the tabular grains have a mean diameter of greater than 1.5 μm. As is customary in the art, grain diameter is based the effective circular diameter of the grain—that is, the diameter of a circle having an area equal to the projected area of the grain. The mean diameters of the tabular grains in the overlying layer unit emulsions can range up to the maximum diameters commonly employed in photographic imaging, about 10 μm. A preferred range of mean tabular grain diameters is from about 1.7 to 7 μm. The mean tabular grain diameters referred to above are the mean of the tabular grain population selected to satisfy tabularity requirements.

The tabular grains of the overlying layer unit emulsions in all instances account for at least 50 percent of the total grain projected area. The tabular grains satisfying the tabularity requirements preferably form at least 70 percent and optimally at least 90 percent of total grain projected area in each overlying layer unit.

Extremely low levels of surface gloss are observed when the overlying layer unit silver halide emulsion accounts for about the same proportion of total silver in an image-forming layer unit as in the current Kodak Ektascan HN film product described above—i.e., 25 percent of the total silver. It is preferred that the overlying layer unit silver halide emulsion contain less than 20 percent of the total silver of the image-forming layer unit in which it is located. When the overlying layer unit silver level is about half that of the discontinued product, its surface gloss is still comparable. Significant gloss reductions are possible at overlying layer unit silver levels down to about 5 percent of total silver present in an image-forming layer unit. A preferred range of overlying layer unit silver levels giving primary emphasis to reducing gloss is in the range of from about 15 to 25 percent based on total image-forming layer unit silver. A preferred range of overlying layer unit silver levels for achieving both silver savings and significant gloss reduction is from about 10 to 20 percent based on total image-forming layer unit silver.

Following the criteria provided above, diagnostic photographic elements satisfying the requirements of the invention can be constructed with varied selections of individual component materials well known to those skilled in the art. For conventional radiographic film constructions, such as that of diagnostic photographic film 100 described in connection with FIG. 1, a general discussion of preferred materials selections is provided by *Research Disclosure*, Vol. 184, August 1979, Item 18431, the disclosure of which is here incorporated by reference. *Research Disclosure* is published by Kenneth Mason Publications, Ltd., Dudley Annex, 21a North Street, Emsworth, Hampshire P010 7DQ, England. While the silver halide emulsions disclosed in *Research Disclosure* Item 18431 are useful, preferred emulsions are the subsequently invented high aspect ratio tabular grain emulsions disclosed by *Research Disclosure*, Vol. 225, January 1983, Item 22534, and the thin, intermediate aspect ratio tabular grain emulsions disclosed by Abbott et al U.S. Pat. No. 4,425,426, the disclosures of which here incorporated by reference. These emulsions have tabularities of greater than 25. For diagnostic films, such as film 200, which are not intended to be themselves exposed to X-radiation, conventional radiographic film construction selections as indicated above are also possible, although a still more general selection from conventional photographic film features, such as those summarized by *Research Disclosure*, Vol. 308, December 1989, Item 308119, the disclosure of which is here incorporated by reference, is also contemplated.

The halide content of the silver halide emulsions, both in the emulsion layer units and in the overlying layer unit, can be widely varied. To facilitate rapid-access processing it is generally preferred that the iodide content of the silver halide emulsion layer units be maintained at less than 10 mole percent, based on total silver. When the diagnostic film is intended to be exposed by X-radiation, the balance of the halide in the emulsion layer units is preferably bromide to insure maximum imaging sensitivities. Silver bromide and silver bromoiodide emulsions containing from about 0.5 to 5 mole percent iodide are preferred in the emulsion layer units of films exposed to X-radiation, since in these films maximum sensitivity to reduce patient exposure to X-radiation is sought. The same emulsions, of course, also work well in diagnostic photographic films not exposed to X-radiation—e.g., laser exposed films; but in this latter instance film sensitivity is independent of patient exposure to X-radiation, and the total or partial substitution of chloride for bromide in the silver halide grains to facilitate rapid-access processing is specifically contemplated. Since the silver halide emulsion in the overlying layer unit need not be relied upon for imaging, it is appreciated that silver chloride, silver bromide, silver bromoiodide, silver chlorobromide, silver chloroiodide and silver chlorobromoiodide compositions are all feasible.

The hydrophilic colloids forming the layers of the image-forming layer units can be selected from among the vehicles and vehicle extenders employed in combination with hardeners set out in Sections IX and X of *Research Disclosure*, Item 308119, cited above. Gelating and gelatin-derivatives are specifically contemplated, particularly those containing low levels of methionine, as disclosed by Maskasky U.S. Pat. Nos. 4,713,320 and 4,713,323.

It has been discovered quite unexpectedly that further reductions in surface glare (measured gloss) can be achieved by employing in the image-forming layer units a binder comprised of (a) gelatin or a gelatin-derivative (e.g., acetylated gelatin, phthalated gelatin, etc.) in combination with (b) a carboxymethylated protein (e.g., carboxy-methylated casein) and (c) at least one other hydrophilic colloid selected from the group consisting of polyacrylamide, polysaccharides, and poly-N-vinyl pyrrolidone. Component (a) of the binder can be reduced to the minimal levels needed for peptizing the silver halide grains during emulsion preparation, typically about 5 percent by weight, based on total binder, with the components (b) and (c) accounting for the balance of the binder. The components (b) and (c) together account for about 40 to 95 by weight of the binder based on total binder weight. The component (b) preferably accounts for about 2.5 to 50 percent by weight of the binder based on total binder weight. Plakonov U.S. Pat. No. 3,589,908 is illustrative of these preferred binder compositions. Binders with components (a), (b) and (c) can be present in any or all of the various layers of the image-forming layer units. It is generally preferred to incorporate these binders in one or more of the layers containing silver halide grains—e.g., the interlayer and/or the emulsion layer unit. This binder formulation, while contributing to gloss reduction also increases haze, but not to objectionable levels for most applications. It is nevertheless preferred to employ gelatin or gelatin-derivatives alone as a binder for applications requiring the very highest levels of image sharpness.

Within the requirements of the invention described above, the overcoats of the image-forming layer units can be selected from those well known to those skilled in the art. Useful overcoat layers are described in *Research Disclosure*, Item 18431, cited above, Section IV, the disclosure of which is here incorporated by reference. The overcoat can contain one or more matting agents to obviate adhesion of adjacent stacked diagnostic photographic elements. Matting agents can contribute to reduced surface glare, but, when relied upon alone for surface glare reduction, objectionably increase haze (image sharpness) in concentrations that produce more than very limited reductions in surface glare.

The overcoat can contain an antistatic agent. Additionally or alternatively, one or more antistatic agents can be incorporated in a separate layer between the support and the image-forming layer unit or on the back side of the support. Conventional antistatic agents are disclosed in *Research Disclosure*, Item 18431, cited above, Section III, and in *Research Disclosure*, Item 308119, cited above, Section XIII, the disclosures of which are here incorporated by reference. Transparent conductive metal oxides, such as indium tin oxide, constitute a preferred class of antistatic agents and preferably coated adjacent the support.

Various constructions are known in the art for reducing crossover, as illustrated by *Research Disclosure*, Item 18431, cited above, Section V, here incorporated by reference. The preferred crossover reduction layer units are those containing a processing solution bleachable microcrystalline dye dispersed in a hydrophilic colloid coating vehicle (e.g., gelatin or a gelatin-derivative). A preferred crossover reduction layer unit of this type is disclosed by Dickerson et al U.S. Pat. No. 4,900,652, the disclosure of which is here incorporated by reference.

Although the dual coated diagnostic photographic element of FIG. 1 is shown to be symmetrically coated, it is appreciated that neither sensitometric nor physical symmetry is required. Since only one side of the film faces the viewer, it is apparent that only one of the two image-forming layer units need contain the gloss reduction features of the overlying layer unit. For example, one of the overlying layer units can be constructed omitting the interlayer 115. It is also recognized that a single crossover reduction layer unit can be incorporated for crossover reduction.

EXAMPLES

The invention can be better appreciated by reference to the following specific examples of preferred embodiments. The examples illustrating the invention are indicated by the suffix E while the examples provided for purposes of comparison are indicated by the suffix C. All gelatin containing layers were hardened with 2.5 percent by weight bis(vinylsulfonylmethyl)ether, based on the weight of gelatin. All tabular grain emulsions (hereinafter also designated as T emulsions) consisted predominantly of tabular grains, in all instances greater than 90 percent tabular grains, based on total grain projected areas. All nontabular grain emulsions are hereinafter also designated as 3D emulsions. Except as otherwise noted, all emulsions were silver bromide emulsions.

EXAMPLE 1E (Film 1E)

A diagnostic photographic film, Film 1E, suitable for recording laser images was produced by coating an image-forming layer unit on one side of a transparent photographic film support and an antihalation pelloid layer on the opposite side of the film support.

Film 1E was constructed using a blue-tinted poly(ethylene terephthalate) film support. The antihalation pelloid layer consisted of 34.4 mg/dm$^2$ gelatin containing 1.3 mg/dm$^2$ bis[3-methyl-1-(p-sulfophenyl)-2-pyrazol-5-one-(4)]pentamethinoxanol, pyridine salt. A protective layer consisting of 8.8 mg/dm$^2$ gelatin was coated over the antihalation pelloid layer.

A light-sensitive emulsion layer unit (hereinafter referred to ELU) was coated on the opposite side of the film support. The emulsion layer unit consisted of a blend of a tabular grain emulsion and a cubic grain emulsion. The tabular grains exhibited a mean tabular grain diameter of 0.8 μm and a mean tabular grain thickness of 0.13 μm, with a tabularity of approximately 50. The cubic grain emulsion exhibited a 0.28 μm mean grain edge length. These two emulsions were blended in a 1:1 silver ratio to provide a total silver coverage as coated of 25.8 mg/dm$^2$. Each emulsion was spectrally sensitized with 235 mg per silver mole of anhydro-9-ethyl-3,3'-di(3-sulfopropyl)-4,5,4',5'-dibenzothia-carbocyanine hydroxide, triethylammonium salt. The blended emulsion vehicle contained 17.5 mg/dm$^2$ gelatin, 2.7 mg/dm$^2$ polyacrylamide, 5.4 mg/dm$^2$ dextran, and 1.6 mg/dm$^2$ carboxymethyl casein (referred to below as PDC).

An overlying layer unit (also referred to below as OLLU) was coated over the blended emulsion layer. The overlying layer unit consisted of an interlayer coated on the blended emulsion layer and a protective overcoat. The interlayer consisted of 4.5 mg/dm$^2$ gelatin and contained 1.1 mg/dm$^2$ silver (4% by weight of total silver in the ELU and OLLU, referred to below as % Ag) in the form of a tabular grain emulsion in which the tabular grains exhibited a mean diameter of 3.4 μm and a mean thickness of 0.13 μm for a tabularity of approximately 200. The protective overcoat consisted of 4.5 mg/dm$^2$ of gelatin.

Film 1E was imagewise exposed using a helium-neon laser (625 nm) and then processed in a RP X-Omat TM rapid processor in 90 seconds as follows:

| | |
|---|---|
| development | 20 seconds at 40° C., |
| fixing | 12 seconds at 40° C., |
| washing | 8 seconds at 40° C., and |
| drying | 20 seconds at 65° C., |

where the remaining time is taken up in transport between processing steps. The development step employs the following developer:

| | |
|---|---|
| Hydroquinone | 30 g |
| 1-Phenyl-3-pyrazolidone | 1.5 g |
| KOH | 21 g |
| $NaHCO_3$ | 7.5 g |
| $K_2SO_3$ | 44.2 g |
| $Na_2S_2O_5$ | 12.6 g |
| NaBr | 35 g |
| 5-Methylbenzotriazole | 0.06 g |
| Glutaraldehyde | 4.9 g |
| Water to 1 liter at pH 10.0, and the fixing step employs the following fixing composition: | |
| Ammonium thiosulfate, 60% | 260.0 g |
| Sodium bisulfite | 180.0 g |
| Boric acid | 25.0 g |
| Acetic acid | 10.0 g |
| Aluminum sulfate | 8.0 g |
| Water to 1 liter at pH 3.9 to 4.5. | |

Samples of Film 1E were measured for specular gloss before processing, hereinafter referred to as raw gloss. Raw gloss is of no interest to the film user, since the films are not viewed before processing, but is included to provide a basis for comparing the initial surface smoothness of the film with that of other films.

The glossiness of the film of interest to a viewer is the specular gloss from maximum density areas after processing, hereinafter referred to as processed gloss. Maximum density, reported below, is also referred below as Dmax. Glossiness was measured at a reflectance angle from the film surface of 20° using a Hunter glossmeter. Both raw and processed gloss measurements were undertaken in accordance with the general gloss measurement approach outlined by J. S. Lavelle, "Gloss: Theory and Its Application to Printed Ink Films", National Printing Ink Research Institute, Lehigh University, Bethlehem, Pa, 1982.

EXAMPLE 2E (Film 2E)

Example 1E was repeated, but with the % Ag in the OLLU being doubled to 8%.

EXAMPLE 3E (Film 3E)

Example 2E was repeated, but with the % Ag in the OLLU being doubled to 16%.

EXAMPLE 4E (Film 4E)

Example 3E was repeated, except that the emulsion layer unit contained 28.5 mg/dm$^2$ gelatin and did not contain polyacrylamide, dextran or carboxymethyl casein (PDC).

EXAMPLE 5E (Film 5E)

Example 4E was repeated, except that the interlayer of the OLLU contained a tabular grain emulsion having a mean tabular grain diameter of 1.7 μm. With tabular grain thickness being unchanged, the tabularity of the interlayer emulsion tabular grain population was reduced by half to approximately 100.

EXAMPLE 6C (Film 6C)

Example 4E was repeated, except that the interlayer of the OLLU contained a tabular grain emulsion having a mean tabular grain diameter of 1.0 μm. With tabular grain thickness being unchanged, the tabularity of the interlayer emulsion tabular grain population was reduced to 69.

EXAMPLE 7C (Film 7C, latest Kodak Ektascan HN TM Film)

Example 4E was repeated, except that the emulsion contained in the ELU, though having a similar silver coverage, consisted entirely of a spherical grain emulsion, and the emulsion contained in the OLLU contained nontabular (3D) grains having a mean diameter of 1.0 μm, with the % Ag in the OLLU being 32%.

EXAMPLE 8C (Film 8C, first Kodak Ektascan HN TM Film)

Example 7C was repeated, but the % Ag in the OLLU was reduced to 16%.

EXAMPLE 9C (Film 9C)

Example 8C was repeated, but with silver being omitted from the OLLU.

EXAMPLE 10C (Film 10C)

Example 9C was repeated, but with PDC being included in the vehicle of the ELU.

SUMMARY AND DISCUSSION OF RESULTS

A tabulation of significant variances in film construction, raw gloss, processed gloss and maximum density levels is set out below in Table I.

TABLE I

| | OLLU | | | Gloss | | |
|---|---|---|---|---|---|---|
| Film | Grains | ECD | % Ag | Raw | Processed | Dmax |
| 1E* | T | 3.4 | 4 | 17.0 | 6.1 | 3.15 |
| 2E* | T | 3.4 | 8 | 16.7 | 3.6 | 3.14 |
| 3E* | T | 3.4 | 16 | 15.0 | 1.7 | 3.14 |
| 4E | T | 3.4 | 16 | 14.0 | 4.8 | 3.43 |
| 5E | T | 1.7 | 16 | 15.5 | 5.7 | 3.40 |
| 6C | T | 1.0 | 16 | 17.0 | 16.5 | 3.34 |
| 7C | 3D | 1.0 | 32 | 4.8 | 4.4 | 3.39 |
| 8C | 3D | 1.0 | 16 | 19.5 | 22.0 | 3.32 |
| 9C | — | — | 0 | 46.0 | 46.0 | 3.38 |
| 10C* | — | — | 0 | 35.0 | 33.0 | 3.38 |

*PDC
OLLU = Overlying layer unit
T = Tabular grain emulsion
3D = Emulsion with nontabular grains
% Ag = Silver in OLLU as a percentage of total silver in film
Gloss
Raw = Glossiness before processing
Processed = Glossiness after processing
Dmax = Maximum density of processed film
PDC = Emulsion layer unit vehicle contained, in addition to gelatin, polyacrylamide, dextran, and carboxymethyl casein From Table I it is apparent that the highest level of glossiness was obtained in Film 9C, which contained no silver halide grains in the overlying layer unit. The glossiness was identical before and after processing.

By comparing Films 10C and 9C it is apparent that adding a mixture of polyacrylamide, dextran, and carboxymethyl casein to the vehicle of the emulsion layer unit was effective in achieving a modest reduction in glossiness. However, the reduction was insufficient to produce more than a slight reduction of surface glare from maximum density areas of the film.

Referring to Film 7C, current Kodak Ektascan HN TM Film, it can be seen that addition of nontabular silver halide grains to the overlying layer unit reduced glossiness to a low level compatible with viewing only low levels of specular reflection from maximum density areas. However, the amount of silver used accounted for 32 percent of the total silver present in the film. In other words nearly one third of the silver in the film was not incorporated in the emulsion layer unit. This film was therefore objectionable in requiring high silver coverages.

Comparing Films 4E and 7C it can be seen that by substituting a tabular grain emulsion for the nontabular emulsion in the overlying unit unit it is possible to obtain a comparable level of glossiness in the processed film in maximum density areas while reducing the amount of silver in the overlying layer unit to half its value in Film 7C. Thus, an unexpected advantage in silver coverage was realized. The fact that the raw gloss of Film 4E was much higher than in Film 7C rendered the low glossiness in the processed film 4E even more surprising.

Comparing Films 4E, 5E and 6C the importance of properly selecting the mean diameters of the tabular grains in the overlying layer units becomes apparent. Surprisingly, when the mean grain diameters are reduced by half from 3.4 μm (Film 4E) to 1.7 μm (Film 5E) only a slight increase in glossiness of the processed film is observed. However, when the mean diameter of the tabular grains in the overlying layer unit was reduced to 1 μm, objectionably high levels of glossiness in the processed film were observed. This led to the unexpected discovery that the mean diameters of the tabular grains must be greater than about 1.5 μm for glossiness reduction to be effectively achieved by incorporating tabular grain emulsions in the overlying layer unit.

By comparing Films 4E and 3E it is apparent that the addition of polyacrylamide, dextran, and carboxymethyl casein to the gelatin vehicle of the emulsion layer unit is effective in achieving minimum levels of glossiness in the processed film.

By comparing Films 1E and 2E with Film C7 it is apparent that the present invention permits one fourth the level of silver to be achieved in the overlying layer unit while achieving greater reductions in processed glossiness than obtained in Film C7. By accepting only slightly higher levels of gloss the silver coverage of the overlying layer unit can be reduced to one eighth that of Film C7 by substituting a tabular grain emulsion for the nontabular grain emulsion in the overlying layer unit.

EXAMPLES 11-14

It is, of course, recognized in the art that matting agents can reduce glossiness by roughening the surface of a photographic film. Unfortunately, the film has a roughened surface both before and after exposure. This reduces image sharpness.

EXAMPLE 11C (Film 11C)

Example 9C was repeated, but with the interlayer and overcoat of 10C being replaced by an overcoat containing 31.2 mg/dm$^2$ gelatin and poly(methyl methacrylate) matting agent beads having a mean diameter in the range of from 1.5 to 2 μm. The coating density of the beads was 0.2 mg/dm$^2$. Processed gloss was 33.

EXAMPLE 12C (Film 12C)

Example 11C was repeated, but the coating density of the beads was 0.4 mg/dm$^2$. Processed gloss was 25.

EXAMPLE 13C (Film 13C)

Example 12C was repeated, but the coating density of the beads was 0.6 mg/dm$^2$. Processed gloss was 16.

DISCUSSION OF RESULTS

Comparing Films 11C, 12C and 13C with Film 9C it is clear that reduction in surface gloss can be achieved using matting agent beads. Comparing Films 11C, 12C and 13C with Films 1E, 2E, 3E, 4E and 5E, it can be seen that processed surface gloss was in every instance lower when the features of the invention were present. While it should be possible to further reduce processed surface gloss by using higher concentrations of matting agents beads, no higher loadings of matting agent beads was undertaken, since haze (image unsharpness) was also rising with each incremental increase in matting agent bead coating coverages. At the highest level of matting agent bead coverage, Film 13C was demonstrating higher levels of haze than any one of Films 1E, 2E, 3E, 4E and 5E. Comparing Films 4E and 13C, haze was approximately 4 times higher in Film 13C. Comparing Films 5E and 13C, haze was approximately 3.5 times higher in Film 13C. The haze advantages of Films 1E, 2E and 3E were not nearly as large, since the presence of polyacrylamide, dextran and carboxymethyl casein in the emulsion layer unit significantly increases haze, but not above acceptable levels.

The invention has been described in detail with particular reference to preferred embodiments thereof, but it will be understood that variations and modifications can be effected within the spirit and scope of the invention.

What is claimed is:

1. A diagnostic photographic film capable of producing a viewable silver image and exhibiting reduced surface glare when processed in up to 90 seconds comprised of a film support, at least one image-forming layer unit coated on the support containing less than 65 mg/dm$^2$ of hydrophilic colloid, the image-forming layer unit being comprised of a silver halide emulsion layer unit containing radiation-sensitive silver halide grains and at least one hydrophilic colloid and an overlying layer unit containing a silver halide emulsion and less than 25 percent of the total hydrophilic colloid present in the image-forming layer unit, characterized in that the overlying layer unit contains a tabular grain silver halide emulsion in which the tabular grains have an average diameter greater than 1.5 μm and an average tabularity of greater than 25, where the tabularity of each tabular grain is the ratio of its effective circular diameter in micrometers divided by the square of its thickness measured in micrometers.

2. A diagnostic photographic element according to claim 1 in which the overlying layer unit is comprised of a hydrophilic colloid overcoat and a silver halide emulsion interlayer interposed between said silver halide emulsion layer unit and said overcoat.

3. A diagnostic photographic film according to claim 2 further characterized in that the film support is transparent.

4. A diagnostic photographic film according to claim 3 further characterized in that first and second of the image-forming layer units are coated on opposite sides of the support, the image-forming layer units each containing from 35 to 65 mg/dm$^2$ of hydrophilic colloid.

5. A diagnostic photographic film according to claim 4 further characterized in that the first and second image-forming layer units are each comprised of a silver halide emulsion layer unit containing a tabular grain emulsion in which the tabular grains have an average tabularity of greater than 25.

6. A diagnostic photographic film according to claim 5 further characterized in that the first and second of the image-forming layer units are each comprised of a silver halide emulsion layer unit containing 18 to 30 mg/dm$^2$ of silver.

7. A diagnostic photographic film according to claim 4 further characterized in that a processing solution decolorizable means for reducing crossover is positioned between at least one of the first and second image-forming layer units and the support.

8. A diagnostic photographic film according to claim 3 further characterized in that the one image-forming layer unit is coated on one side of the support and an anticurl and antihalation layer unit is coated on the opposite side of the support.

9. A diagnostic photographic film according to claim 8 further characterized in that the image-forming layer unit contains from 20 to 65 mg/dm$^2$ of hydrophilic colloid.

10. A diagnostic photographic film according to claim 8 further characterized in that the silver halide emulsion layer unit of the image-forming layer unit contains from 25 to 40 mg/dm$^2$ of silver.

11. A diagnostic photographic film according to any one of claims 2 to 10 inclusive further characterized in that the interlayer accounts for less than 20 percent of the total silver in the image-forming layer unit of which it forms a part.

12. A diagnostic photographic film according to claim 11 further characterized in that the interlayer accounts for at least 5 percent of the total silver in the image-forming layer unit of which it forms a part.

13. A diagnostic photographic film according to claim 11 further characterized in that the interlayer contains tabular silver halide grains having an average diameter in the range of from 1.7 to 7 μm.

14. A diagnostic photographic film according to claim 11 further characterized in that the image-forming layer unit contains a binder comprised of (a) gelatin or a gelatin-derivative hydrophilic colloid, (b) a carboxymethylated protein, and (c) at least one other hydrophilic colloid selected from the group consisting of polyacrylamide, polysaccharides, and poly-N-vinylpyrrolidone, (b) and (c) together account for from 40 to 95 percent by weight of the binder, and (b) accounts for 2.5 to 50 percent by weight of the binder.

* * * * *